US006913839B2

(12) United States Patent
Darolia et al.

(10) Patent No.: US 6,913,839 B2
(45) Date of Patent: Jul. 5, 2005

(54) COATED ARTICLE HAVING A QUASICRYSTALLINE-DUCTILE METAL LAYERED COATING WITH HIGH PARTICLE-IMPACT DAMAGE RESISTANCE, AND ITS PREPARATION AND USE

(75) Inventors: Ramgopal Darolia, West Chester, OH (US); Robert Edward Schafrik, Cincinnati, OH (US)

(73) Assignee: General Electric Company, Schenectady, NY (US)

( * ) Notice: Subject to any disclaimer, the term of this patent is extended or adjusted under 35 U.S.C. 154(b) by 196 days.

(21) Appl. No.: 10/377,316

(22) Filed: Feb. 28, 2003

(65) Prior Publication Data

US 2004/0170859 A1 Sep. 2, 2004

(51) Int. Cl.[7] ..... B32B 15/01; B32B 31/00

(52) U.S. Cl. ..... 428/615; 428/636; 428/651; 428/652; 428/653; 428/660; 428/668; 428/680; 428/681; 428/686; 428/908.8; 428/926; 428/937; 428/938

(58) Field of Search ..... 428/615, 636, 428/651, 652, 653, 660, 668, 680, 681, 686, 908.8, 926, 937, 938

(56) References Cited

U.S. PATENT DOCUMENTS

| | | | | |
|---|---|---|---|---|
| 5,652,877 | A | 7/1997 | Dubois et al. | 428/553 |
| 5,888,661 | A | 3/1999 | Dubois et al. | 428/548 |
| 6,183,887 | B1 | 2/2001 | Dubois et al. | 428/651 |
| 6,242,108 | B1 | 6/2001 | Sordelet et al. | 428/615 |
| 6,254,699 | B1 | 7/2001 | Hermanek | 148/403 |
| 6,254,700 | B1 | 7/2001 | Hermanek | 148/403 |

OTHER PUBLICATIONS

K.F. Kelton, "Ti/Zr–Based Quasicrystals–Formation Structure and Hydrogen Storage Properties", Mat. Res.Soc. Symp.Proc. vol. 553, pp. 471–482 (1999) (no month given).

Daniel J. Sordelet et al., "Quasicrystals: Perspectives and Potential Applications", MRS Bulletin, pp. 34–37 (Nov. 1997).

*Primary Examiner*—Robert R. Koehler
(74) *Attorney, Agent, or Firm*—Gregory O. Garmong; Carmen Santa Maria; McNees Wallace & Nurick LLC

(57) ABSTRACT

A coated article having a high resistance to particle-impact damage has a substrate, and a layered coating overlying the substrate. The layered coating includes a substantially continuous quasicrystalline layer, and a substantially continuous ductile metallic layer in facing contact with the quasicrystalline layer. The coated article is preferably used in applications where it is subjected to particle-impact conditions.

16 Claims, 3 Drawing Sheets

COATED ARTICLE HAVING A QUASICRYSTALLINE-DUCTILE METAL LAYERED COATING WITH HIGH PARTICLE-IMPACT DAMAGE RESISTANCE, AND ITS PREPARATION AND USE

This invention relates to the protection of substrates against particle-impact damage and, more particularly, to the use of layered quasicrystalline-ductile metal coatings to provide that protection.

BACKGROUND OF THE INVENTION

In an aircraft gas turbine (et) engine, air is drawn into the front of the engine, compressed by a shaft-mounted compressor, and mixed with fuel. The mixture is combusted, and the resulting hot combustion gases are passed through a turbine mounted on the same shaft. The flow of gas turns the turbine by contacting an airfoil portion of the turbine blade, which turns the shaft and provides power to the compressor. The hot exhaust gases flow from the back of the engine, driving it and the aircraft forward. There may additionally be a bypass fan that forces air around the center core of the engine, driven by a shaft extending from the turbine section.

The compressor and the bypass fan are both rotating structures in which stages of blades extend radially outwardly from a respective compressor or bypass fan rotor disk. The compressor blades have complexly shaped and curved airfoils that compress the air to progressively higher pressures for injection into the combustors. The fan blades are also complexly shaped and curved to force the air around the center core of the engine and out the trailing end of the engine. The compressor rotor disk and the bypass fan rotor disk turn at thousands of revolutions per minute. In a large gas turbine engine the compressor blades and bypass fan blades may be quite long and extend a substantial distance from the centerline of the engine. Consequently, both the compressor blades and bypass fan blades move through the air at a high velocity.

The compressor blades and the bypass fan blades receive the inward flow of air into the gas turbine engine at a combined velocity determined both by their rotational velocity and by the relative velocity of the engine through the air. The combined velocity is typically at least near Mach 1, and may be considerably greater than Mach 1 in many situations. Any solid or liquid particles in the air—dust, dirt particles, sand, fine water droplets, raindrops, ice, and snow, for example—impact against the compressor blades and the bypass fan blades at the combined velocity. These particles may be of a wide range of masses, from lightweight particles to relatively heavy particles, but are not so heavy that they cause instantaneous fracture of the blades (as could be the case for an ingested bird or the like). Because of the complex shapes of the airfoils of the compressor blades and the bypass fan blades and the change in the combined velocity under different flight conditions, the solid particles impact the various regions, and even the same region, of the blades over a variety of particle-impact angles of incidence.

The particle impacts may collectively cause substantial amounts of particle-impact damage to the compressor-blade airfoils and to the bypass-fan-blade airfoils. In some cases, no action is taken to avoid this damage, which in turn leads to earlier repair or replacement of the compressor blades and/or the bypass fan blades than would otherwise be necessary. In other cases, there have been attempts to apply protective coatings to the surfaces that are impacted by the particles. The most commonly used of such protective coatings is tungsten carbide-cobalt material having particles of tungsten carbide dispersed in a cobalt matrix. The coating material is very heavy and adds to the rotating weight of the compressor blades and bypass fan blades, which in turn leads to greater shaft, bearing, and structural weights. Such coatings are also subject to spallation during service.

There is accordingly a need for an improved approach to the protection of gas turbine components, such as compressor blades and bypass fan blades, and other articles as well, against the damage caused by high-velocity particle-impact damage. The present invention fulfills this need, and further provides related advantages.

SUMMARY OF THE INVENTION

The present invention provides an approach for preparing an article having a layered coating thereon. The layered coating is particularly effective in protecting a substrate against the effects of high-velocity particle-impact damage and may be optimized for this use as described herein, although it is not limited to this use. The preferred coating applied to the substrate protects the substrate from particle-impact damage over the entire range of possible particle-impact angles of incidence. Conventional coatings, by comparison, typically protect against particle-impact damage only over the range of low particle-impact angles or the range of high particle-impact angles, but not both. Consequently, they are useful for a well-controlled particle-impact condition such as may be achieved in laboratory testing of particle-impact damage, but are limited for use in the complex service conditions of many articles such as the gas turbine compressor and bypass fan stages of a gas turbine engine. The coating of the present approach is further optimized to minimize the possibility that cracks in the coating can propagate into the underlying substrate to cause it to fail prematurely.

A coated article comprises a substrate; and a layered coating overlying the substrate. The coating comprises a substantially continuous quasicrystalline layer, and a substantially continuous ductile metallic layer in facing contact with the quasicrystalline layer. It is preferred that the ductile metallic layer contacts the substrate, and the quasicrystalline layer overlies the ductile metallic layer. Alternatively, the quasicrystalline layer may contact the substrate, and the ductile metallic layer overlies the quasicrystalline layer. More preferably, the layered coating comprises a plurality of alternating layers of quasicrystalline material and substantially ductile metallic material. In a typical case, the quasicrystalline layer has a thickness of from about 5 to about 25 micrometers, and the ductile metallic layer has a thickness of from about 5 to about 25 micrometers.

In an application of interest, the substrate is a component of a gas turbine engine. The substrate is preferably a compressor-section airfoil of a gas turbine engine, and specifically a compressor blade airfoil or a bypass fan-blade airfoil.

The quasicrystalline layer, which is a relatively hard, brittle material, may be any operable material but is desirably comprises an alloy selected from the group consisting of an alloy comprising iron, copper, and aluminum; an alloy comprising nickel, copper, and aluminum; an alloy comprising cobalt, copper, and aluminum; an alloy comprising titanium, nickel, and silicon; and an alloy comprising titanium, nickel, and zirconium. The ductile metallic layer may be any operable material, but desirably is an aluminum-base alloy or a titanium-base alloy. The ductile metallic layer is preferably, but not necessarily, a different metal than the substrate. It is preferred that the quasicrystalline layer and the ductile metallic layer each are of about the same coefficient of thermal expansion, and about the same coefficient of thermal expansion as the underlying substrate, to minimize differential thermal expansion thermal stresses and strains resulting from temperature changes during fabrication and during service.

A method for providing a coated article having a high resistance to particle-impact damage comprises the steps of providing a substrate, and applying a layered coating overlying the substrate to form the coated article. The coating comprises a substantially continuous quasicrystalline layer, and a substantially continuous ductile metallic layer in facing contact with the quasicrystalline layer. The coated article is subjected to particle-impact conditions. Operable features and modifications of the approach discussed elsewhere may be utilized in this embodiment as well.

The layered coating includes the relatively hard, low ductility quasicrystalline layer to provide good particle-impact damage resistance at lower particle-impact angles, and the softer, higher-ductility ductile metallic layer to provide particle-impact damage resistance at higher particle-impact angles. If the particle-impact angle to which a particular region is exposed is predominantly low angle, the ductile metallic layer will, to the extent that it is exposed, wear away and expose the more-resistant underlying quasicrystalline layer. If the particle-impact angle to which the particular region is exposed is predominantly high angle, the quasicrystalline layer will, to the extent it is exposed, wear away and expose the more-resistant underlying ductile layer. For this reason, the layered coating preferably has multiple alternating layers of the quasicrystalline material and the ductile material to accommodate a variety of operating conditions and associated particle-impact conditions.

The ductile layer also has the beneficial effect of preventing cracks that may initiate in the relatively brittle quasicrystalline material from propagating inwardly to the substrate, and thence causing premature cracking of the substrate. Any such cracks are blunted and deflected when they reach the ductile layer.

The use of the present layered coating provides a significant improvement in resistance to particle-impact damage as compared with an unprotected substrate article. The present layered coating also has important advantages as compared with conventional protective coatings such as the commonly used tungsten carbide-cobalt nonlayered coating. The present layered coating has significantly lower density than the tungsten carbide-cobalt coating, and a better match to the coefficient of thermal expansion of the substrate in most cases. The present coating provides particle-impact-damage protection over the entire range of particle angles of incidence due to its layered construction.

The present invention thus provides a layered coating that is resistant to particle-impact damage. It is also resistant to initiating premature cracking in the substrate. The layered coating and coated substrate may be used for other applications as well, such as wear and friction applications. In all applications, the structure of the coating avoids inducing premature failure of the substrate due to the formation of cracks in the coating and the propagation of those cracks into the substrate, a particular concern in fatigue-loading conditions. Other features and advantages of the present invention will be apparent from the following more detailed description of the preferred embodiment, taken in conjunction with the accompanying drawings, which illustrate, by way of example, the principles of the invention. The scope of the invention is not, however, limited to this preferred embodiment.

DETAILED DESCRIPTION OF THE INVENTION

Figure 1:
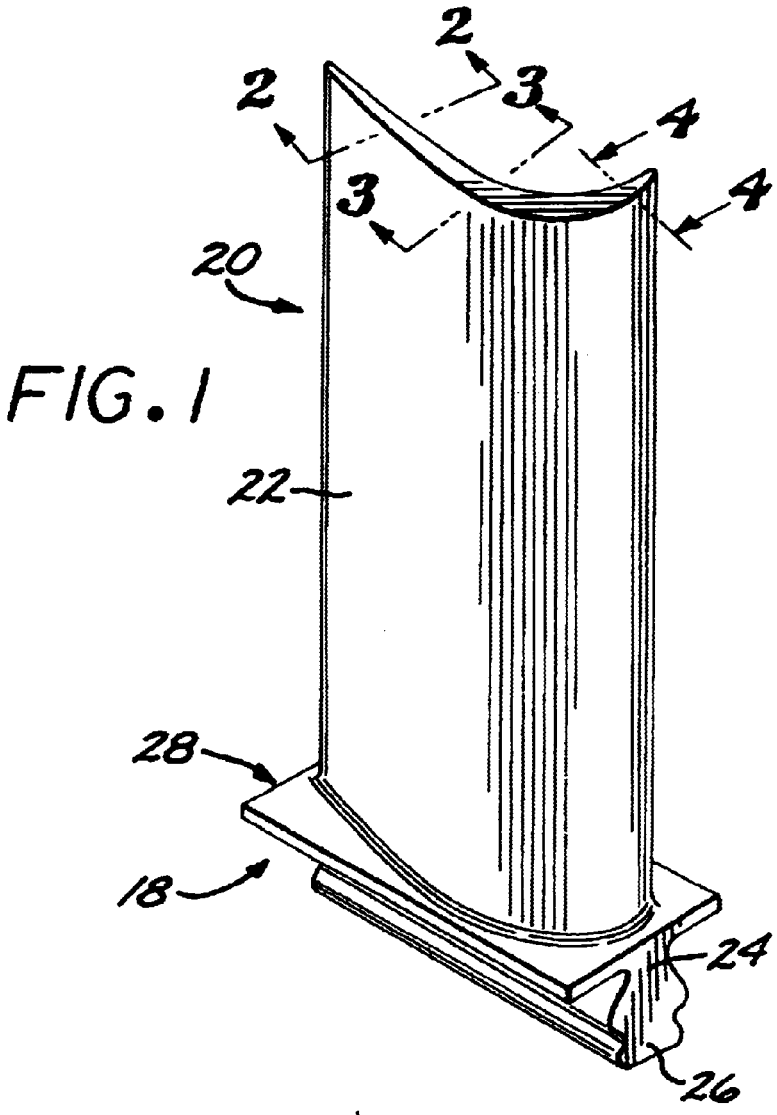
FIG. 1 is a perspective view of a component of a gas turbine engine.

FIG. 1 depicts a coated article 18 in the form of a component of a gas turbine engine, here a compressor blade 20. (A bypass fan blade has a similar appearance in relevant aspects.) The compressor blade 20 may be a new-make article or an article that has previously been in service. The compressor blade 20 has an airfoil 22 against which contacts and compresses the flow of input air to the gas turbine engine during service operation, a downwardly extending shank 24, and an attachment in the form of a dovetail 26 which attaches the compressor blade 20 to a compressor rotor disk (not shown) of the gas turbine engine. A platform 28 extends transversely outwardly at a location between the airfoil 22 and the shank 24.

Figure 2:
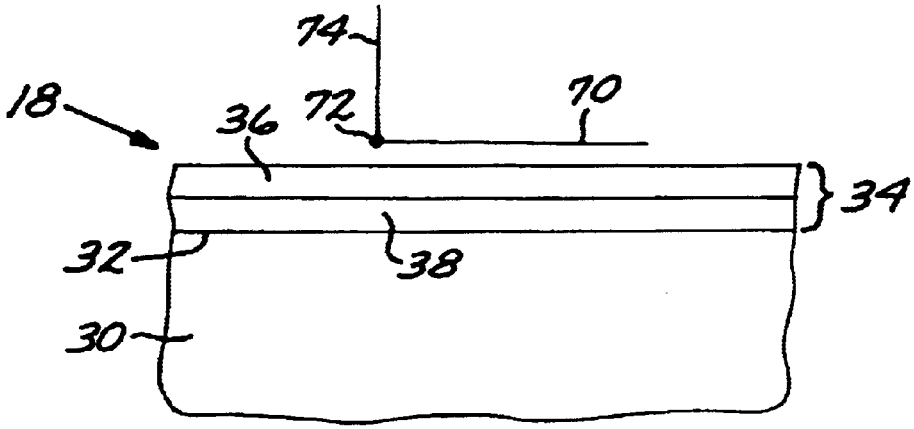
FIG. 2 is an enlarged sectional view of the component of FIG. 1, taken along line 2—2 and illustrating a first embodiment of the layered coating.
Figure 3:
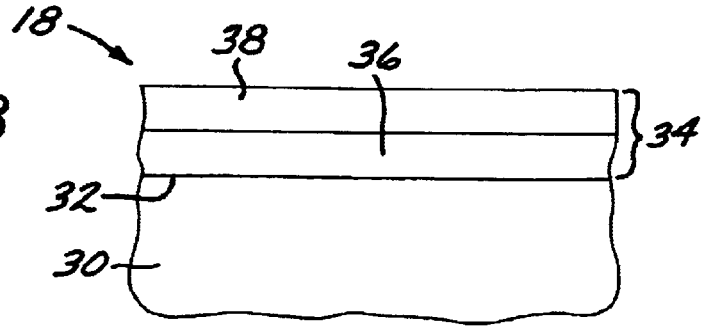
FIG. 3 is an enlarged sectional view of the component of FIG. 1, taken along line 3—3 and illustrating a second embodiment of the layered coating.
Figure 4:
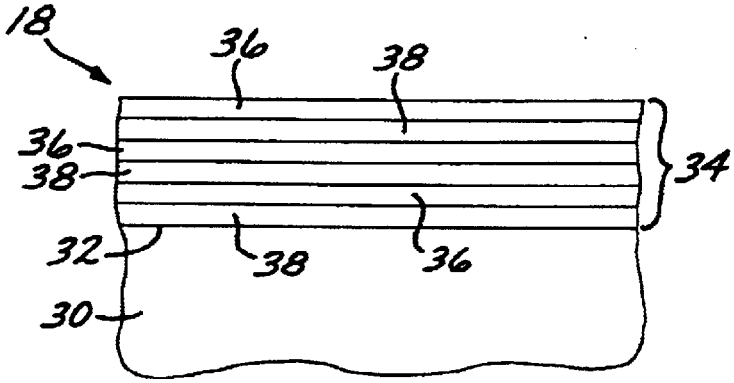
FIG. 4 is an enlarged sectional view of the component of FIG. 1, taken along line 4—4 and illustrating a third embodiment of the layered coating.

FIGS. 2–4 depict three embodiments of the coated article 18. In each case, the uncoated article serves as a substrate 30 have a substrate surface 32. The substrate 30 may be made of any operable metal, with aluminum-base alloys, nickel-base alloys, steels, and titanium-base alloys of particular interest. A layered coating 34 overlies the surface 32 of the substrate 30. The layered coating 34 comprises a substantially continuous quasicrystalline layer 36, and a substantially continuous ductile metallic layer 38 in facing contact with the quasicrystalline layer 36. In the embodiment of FIG. 2, the ductile metallic layer 38 contacts the surface 32 of the substrate 30, and the quasicrystalline layer 36 overlies the ductile metallic layer 38. In the embodiment of FIG. 3, the quasicrystalline layer 36 contacts the surface 32 of the substrate 30, and the ductile metallic layer 38 overlies the quasicrystalline layer 36. Embodiments in which the ductile metallic layer 38 contacts the surface 32 of the substrate 30 are preferred to those in which the quasicrystalline layer 36 contacts the surface 30 of the substrate. Preferably but not necessarily, the quasicrystalline layer 36 has a thickness of from about 5 to about 25 micrometers, and the ductile metallic layer 38 has a thickness of from about 5 to about 25 micrometers.

The layered coating 34 may have a plurality of alternating layers of quasicrystalline material 36 and substantially ductile metallic material 38, as illustrated in FIG. 4. Most preferably, the layer contacting the surface 32 of the substrate is one of the ductile metallic layers 38. The various quasicrystalline layers 36 may be of the same or different quasicrystalline materials and compositions. The various ductile metallic layers 38 may be the same or different metallic materials and compositions. The sum of the thicknesses of the individual types of layers may be the same as that set for a single layer in the embodiments of FIGS. 2–3, or it may be greater or smaller. Care is taken for all of the embodiments of FIGS. 2–4 that the thickness and contour of the layered coating 34 is that required by the aerodynamics and the specification requirements for the overall coated article 18.

Quasicrystalline materials used in the quasicrystalline layer 36 are known in the art. Examples are found in alloys comprising iron, copper, and aluminum; alloys comprising nickel, copper, and aluminum; alloys comprising cobalt, copper, and aluminum; alloys comprising titanium, nickel, and silicon; and alloys comprising titanium, nickel, and zirconium (e.g., $Ti_{45}$—$Zr_{38}$—$Ni_{17}$). Discussions of quasicrystalline alloys and operable compositions may be found in U.S. Pat. Nos. 6,254,699; 6,242,108; 6,183,887; 5,888,661; and 5,652,877, and publications such as K. F. Kelton, "Ti/Zr-Based Quasicrystals—Formation, Structure, and Hydrogen Storage Properties", Mat. Res. Soc. Symp. Proc., Vol. 553 (1999), page 471, whose disclosures are incorporated by reference. The quasicrystalline materials are generally stable at elevated temperatures of up to 650° C. or higher, sufficient for most compressor blade and bypass fan blade applications. The field of quasicrystalline materials is relatively new, and additional alloys are being discovered. The present approach is operable with existing and newly discovered quasicrystalline materials. Generally, quasicrystalline alloys are hard, with very limited ductilities (elongations to failure), and thence may be described as "brittle" herein.

Metals used in the ductile metallic layer 38 are ductile, that is, having a relatively high elongation to failure. The ductile metallic layer 38 is preferably made of a material different from the substrate 30, and having a higher ductility (that is, greater elongation to failure in tension) than the substrate. As used herein, "ductile" and "brittle" are used in a relative sense to each other, and not in any absolute sense. A "ductile" metal has an elongation to failure in tension that is greater than that of the "brittle" quasicrystalline material. A "ductile" metal typically has an elongation to failure of at least about 2 percent in tension, when tested at room temperature. The ductile metallic layer 38 preferably is a metal having a composition and/or a coefficient of thermal expansion relatively close to that of the quasicrystalline layer 36, and a coefficient of thermal expansion relatively close to that of the substrate 30, to minimize the incidence of thermal expansion mismatch stains and stresses that lead to cracking and/or spalling of the layered coating 34. As used herein, "relatively close" as applied to coefficients of thermal expansion means that the coefficients of thermal expansion are within about $2\times10^{-6}$/° F. of each other.

Each of the layers 36 and 38 is "substantially continuous", a term used herein to distinguish their layered structures from morphologies that are not within the scope of the invention and in which small pieces of the quasicrystalline material are dispersed within a layer of the ductile metal, or small pieces of the ductile metal are dispersed within a layer of the quasicrystalline metal, but which do not have multiple overlying layers comprising the quasicrystalline material and the ductile material. (However, in the present approach each layer may have second phases or dispersoids distributed therethrough, as long as the matrix of the layer is substantially continuous.) The conventional coating of small pieces of tungsten carbide dispersed in a cobalt matrix is another case in which the two materials are not each "substantially continuous", and this material is not within the scope of the present approach. In the structure according to the present approach, each layer 36 and 38 need not be fully continuous over the entire surface 32 of the substrate, because in some cases only certain portions of the surface 32 need be protected and in other cases some portions of the layers 36 and 38 may be removed by particle-impact damage during service, as will be discussed in relation to FIG. 6. Preferably, in the "substantially continuous" layered structure, each layer 36 and 38 extends in the in-plane orthogonal directions 70 and 72 (FIG. 2) at least 10 times the thickness of the layer in a perpendicular direction 74 to the in-plane orthogonal directions 70 and 72.

Figure 5:
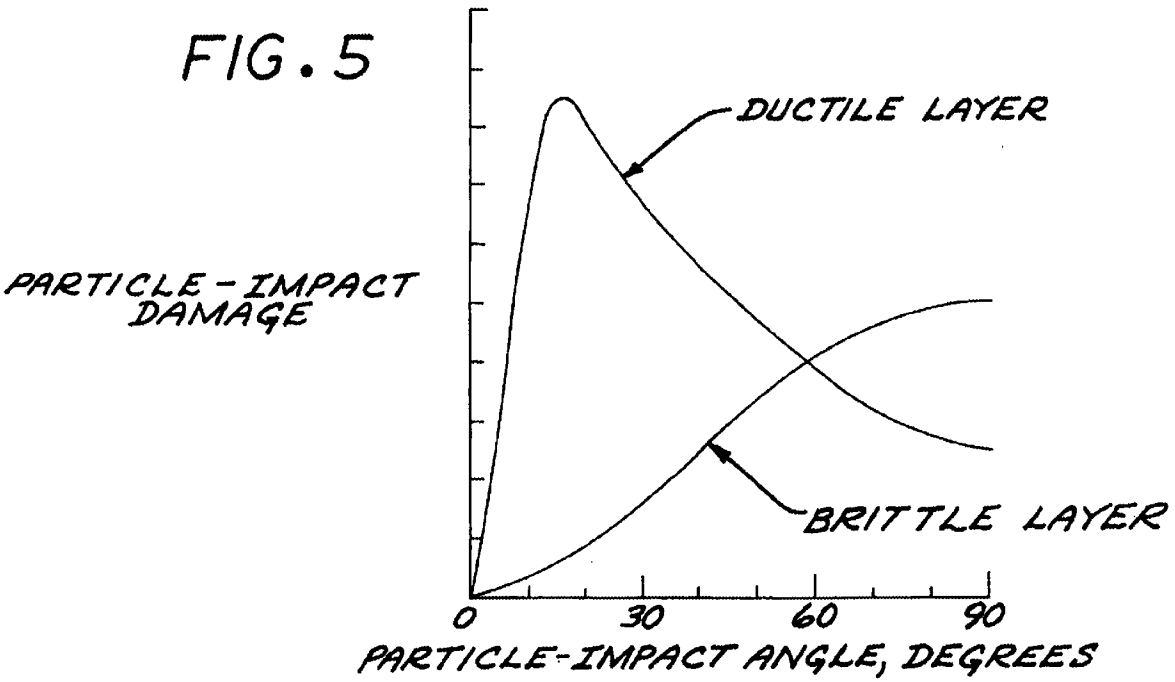
FIG. 5 is a schematic graph of particle-impact damage as a function of particle-impact angle of incidence.

FIG. 5 illustrates one important reason for selecting the present substantially continuous-layer morphology. A relatively brittle layer, such as the quasicrystalline layer 36, suffers low particle-impact damage for low impact angles (that is, particle-impact angles that are closer to a grazing of incidence to the surface 32 and increasing particle-impact damage at higher particle-impact angles. Thus, the less-ductile quasicrystalline layer 36 is best suited for low particle-impact angles. A relatively ductile layer, such as the ductile metallic layer 38, has higher particle-impact damage than the quasicrystalline layer 36 at low particle-impact angles, but has lower particle-impact damage for higher particle-impact angles (that is, angles that are nearer to vertical to the exposed surface of the coated article).

Figure 6:
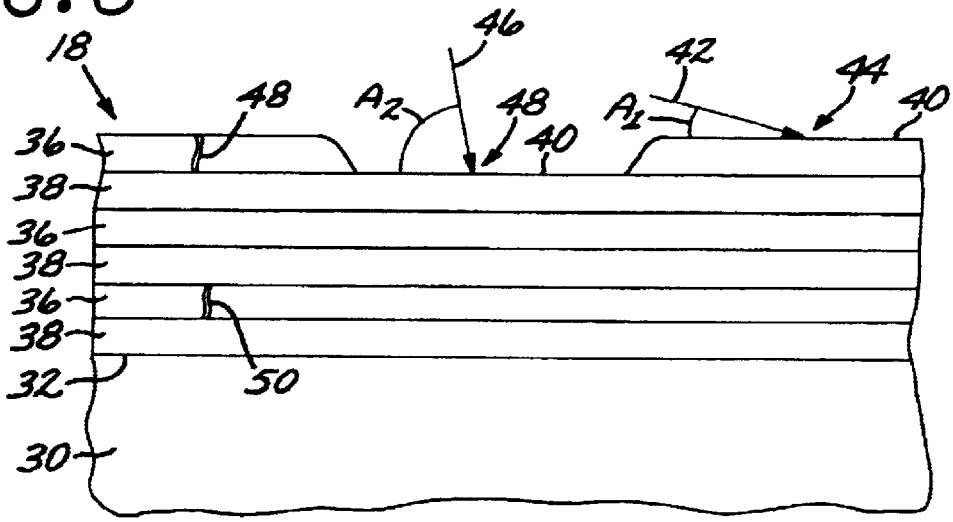
FIG. 6 is a schematic enlarged sectional view of the third embodiment of the layered coating, illustrating the effect of different types of particle-impact damage.

As illustrated in FIG. 6, if the particle-impact angle $A_1$ of particles impinging upon an exposed surface 40 of the coated article 18 along impact vector 42 in a first region 44 is relatively low, the quasicrystalline layer 36 is most resistant to particle-impact damage and remains in place. On the other hand, if the particle-impact angle $A_2$ of particles impinging upon the exposed surface 40 of the coated article 18 along impact vector 46 in a second region 48 is relatively high, the quasicrystalline layer 36 is damaged and removed, leaving the underlying ductile metallic layer 38 exposed to resist further high-impact-angle particle-impact damage. In many common applications, the angle of the impact vector varies from region to region across the exposed surface, but there are predominant angular modes in each region. Thus, damage is accommodated in the illustrated manner. The multilayer structure of FIGS. 4 and 6 is preferred because it can accommodate a variety of static and varying impact-angle conditions before the particle-impact damage penetrates to the surface 32 and thence into the substrate 30.

Another advantage of using the layered coating 34 is that the ductile metallic layer(s) 38 serve(s) to block crack propagation of cracks in the less-ductile quasicrystalline layer(s). Such cracks are of particular concern in applications where the substrate is subjected to conditions of fatigue. If cracks initiating in the coating were allowed to propagate into the substrate, they could serve as initiation sites for premature fatigue failure of the substrate. Thus, in a conventional brittle coating, if a crack initiates in the brittle coating, the crack may propagate into the substrate and thereby accelerate its premature failure. In the present layered coating 34 of the present approach, if a crack 48 initiates in the quasicrystalline layer 36 at the exposed surface 40, the propagation of the crack 48 is blunted and deflected by the underlying ductile metallic layer 38. Similarly, if a crack 50 initiates in a buried quasicrystalline layer 36, due to thermal stresses or other reasons, its propagation is blunted and deflected by the ductile metallic layers 38 above and below the cracked quasicrystalline layer 36. Crack propagation from the coating into the substrate is thereby prevented, and there is no fatigue deficit associated with the presence of the coating. Cracked quasicrystalline layers 36 are still able to function partially in resisting impact damage, so the structure with alternating layers 36 and 38 allows the layered coating 34 to continue its protective role even though quasicrystalline layers 36 may be cracked.

Figure 7:
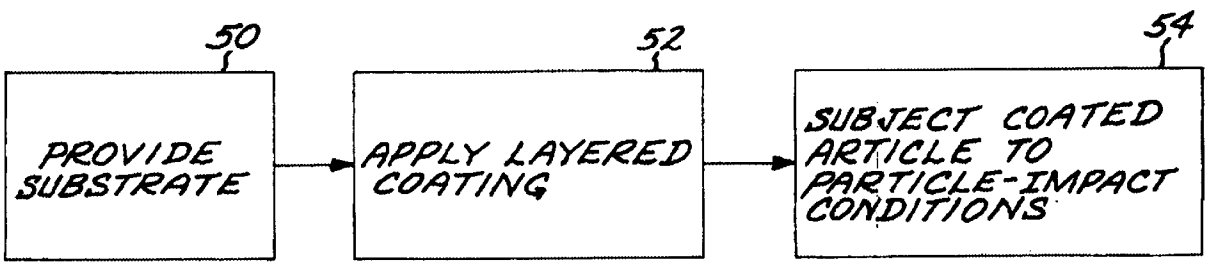
FIG. 7 is a block flow diagram of a method for preparing and using the coated article.

FIG. 7 depicts a preferred method for practicing the invention. The substrate 30 is provided, step 50. The substrate 30 has the desired shape and dimensions of the final coated article, except that it may be slightly undersize dimensionally to account for the thickness of the layered coating. The layered coating 34 is applied to the surface 32 of the substrate 30, step 52. The application of the layers 36 and 38 is by any operable method, and to any desired thickness. The layers 36 and 38 need not be applied by the same techniques, although that is preferred as a matter of manufacturing efficiency. Preferred application techniques used in step 52 include physical vapor deposition techniques such as electron beam physical vapor deposition, sputtering, and cathodic arc, and plasma spray techniques such as air plasma spray, low pressure plasma spray, and high velocity oxyfuel deposition. All of these techniques are known in the art for other applications.

As described above, the structure according to the present approach has been determined to be particularly useful in conditions of particle-impact damage, and has been optimized for that application. The use of the coated substrate is not limited to this application, however. It may be used in applications requiring other properties such as wear resistance and low friction, for example. In all cases, however, it realizes advantages such as not inducing premature fatigue failure of the substrate.

Although a particular embodiment of the invention has been described in detail for purposes of illustration, various modifications and enhancements may be made without departing from the spirit and scope of the invention. Accordingly, the invention is not to be limited except as by the appended claims.

What is claimed is:

1. A coated article comprising:

a substrate; and a layered coating overlying the substrate, the layered coating comprising a substantially continuous quasicrystalline layer, and a substantially continuous ductile metallic layer in facing contact with the quasicrystalline layer.

2. The coated article of claim 1, wherein the layered coating comprises a plurality of alternating layers of quasicrystalline material and substantially ductile metallic material.

3. The coated article of claim 1, wherein the ductile metallic layer contacts the substrate, and the quasicrystalline layer overlies the ductile metallic layer.

4. The coated article of claim 1, wherein the quasicrystalline layer contacts the substrate, and the ductile metallic layer overlies the quasicrystalline layer.

5. The coated article of claim 1, wherein the quasicrystalline layer has a thickness of from about 5 to about 25 micrometers, and the ductile metallic layer has a thickness of from about 5 to about 25 micrometers.

6. The coated article of claim 1, wherein the substrate is a component of a gas turbine engine.

7. The coated article of claim 1, wherein the substrate is a compressor-section airfoil of a gas turbine engine selected from the group consisting of a compressor blade airfoil and a bypass fan-blade airfoil.

8. The coated article of claim 1, wherein the quasicrystalline layer comprises an alloy selected from the group consisting of an alloy comprising iron, copper, and aluminum; an alloy comprising nickel, copper and aluminum; an alloy comprising cobalt, copper, and aluminum; an alloy comprising titanium, nickel, and silicon; and an alloy comprising titanium, nickel, and zirconium.

9. A method for providing a coated article having a high resistance to particle-impact damage, comprising the steps of:

providing a substrate;

applying a layered coating overlying the substrate to form the coated article, the layered coating comprising a substantially continuous quasicrystalline layer, and a substantially continuous ductile metallic layer in facing contact with the quasicrystalline layer; and subjecting the coated article to particle-impact conditions.

10. The method of claim 9, wherein the step of providing the substrate includes the step of providing the substrate that is a component of a gas turbine engine.

11. The method of claim 9, wherein the step of providing the substrate includes the step of providing the substrate that is a compressor-section airfoil of a gas turbine engine selected from the group consisting of a compressor blade airfoil and a bypass fan-blade airfoil.

12. The method of claim 9, wherein the step of applying includes the step of applying a plurality of alternating layers of quasicrystalline material and substantially ductile metallic material.

13. The method of claim 9, wherein the step of applying includes the step of applying the ductile metallic layer contacting the substrate, and the quasicrystalline layer overlying the ductile metallic layer.

14. The method of claim 9, wherein the step of applying includes the step of applying the quasicrystalline layer contacting the substrate, and the ductile metallic layer overlying the quasicrystalline layer.

15. The method of claim 9, wherein the step of applying includes the steps of applying the quasicrystalline layer having a thickness of from about 5 to about 25 micrometers, and applying the ductile metallic layer having a thickness of from about 5 to about 25 micrometers.

16. The method of claim 9, wherein the step of applying includes the steps of applying the quasicrystalline layer comprising an alloy selected from the group consisting of an alloy comprising iron, copper, and aluminum; an alloy comprising nickel, copper and aluminum; an alloy comprising cobalt, copper, and aluminum; an alloy comprising titanium, nickel, and silicon; and an alloy comprising titanium, nickel, and zirconium.

* * * * *